United States Patent [19]

Schakat

[11] 3,972,097

[45] Aug. 3, 1976

[54] TOOL FOR ATTACHMENT TO THE DIPPER ARM OF AN EXCAVATOR

[75] Inventor: Rudi Schakat, Schloss Neuhaus, Germany

[73] Assignee: O & K Orenstein & Koppel Aktiengesellschaft, Berlin, Germany

[22] Filed: Oct. 10, 1974

[21] Appl. No.: 513,764

[52] U.S. Cl. ..... 29/33 R; 214/138 R; 214/147 R; 30/228

[51] Int. Cl.[2] ..... E02F 3/28

[58] Field of Search ..... 294/104; 214/147 R, 214/147 G, 650 R, 653, 138; 30/123 R, 173, 203, 227, 228; 29/33 R, 403

[56] References Cited

UNITED STATES PATENTS

| | | | |
|---|---|---|---|
| 245,122 | 8/1881 | Bishop | 30/227 |
| 638,116 | 11/1899 | Herwick et al. | 30/227 |
| 3,275,172 | 9/1966 | Smith | 214/147 R X |
| 3,550,655 | 12/1970 | Murphy | 214/147 R X |

*Primary Examiner*—Frank E. Werner
*Attorney, Agent, or Firm*—Walter Becker

[57] ABSTRACT

A tool forming an attachment to the dipper arm of an excavator, especially for processing scrap automobiles, which includes an extension member that is fixedly connected to the dipper arm and projects beyond the free end portion of the latter. The free end portion of this extension member forms a gripping and shearing structure with a ripping tooth member which preferably forms a two-arm lever pivotally supported by the free outer end of the dipper arm. The longer arm of the two-arm lever cooperates with the extension member while forming a gripping device therewith, whereas the shorter arm of the two-arm lever cooperates with a shearing member supported by the extension member and forms a shear therewith.

1 Claim, 2 Drawing Figures

TOOL FOR ATTACHMENT TO THE DIPPER ARM OF AN EXCAVATOR

The present invention relates to a tool for attachment to the dipper arm of a hydraulic excavator for processing scrap automobiles. In order to be able to convey scrap automobiles to a scrap press, it was heretofore customary for purposes of first removing non-metallic parts, especially upholstered parts and tires, to employ human work forces because the customary working tools as for instance hydraulic excavators, attachments, etc., have not proved suitable to enter the bodies or to remove rubber tires from the rims in view of the relatively small surfaces.

It is, therefore, an object of the present invention to make a device which is made in mass production and is hydraulically driven, especially a customary hydraulic excavator with simple means, which will be suitable for carrying out the above mentioned operations.

Figure 1:
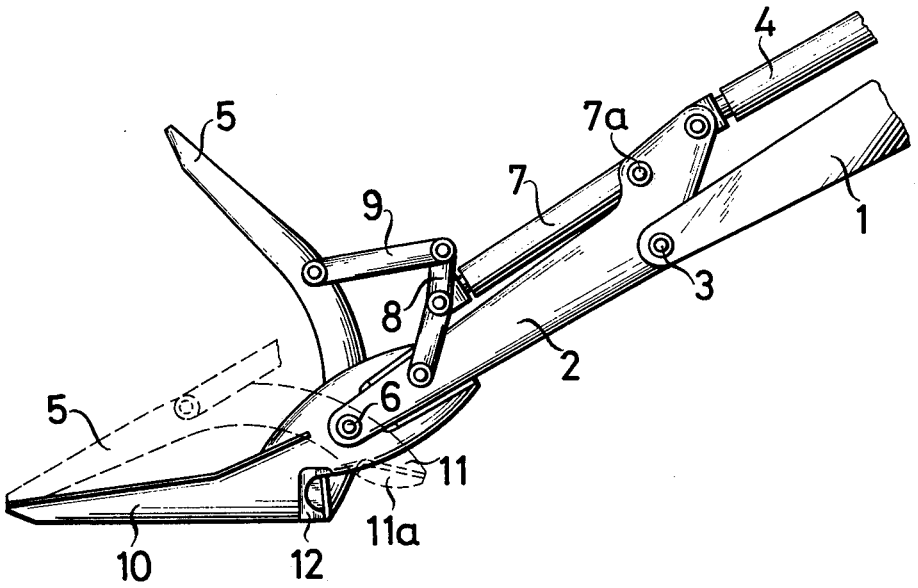
Figure 2:
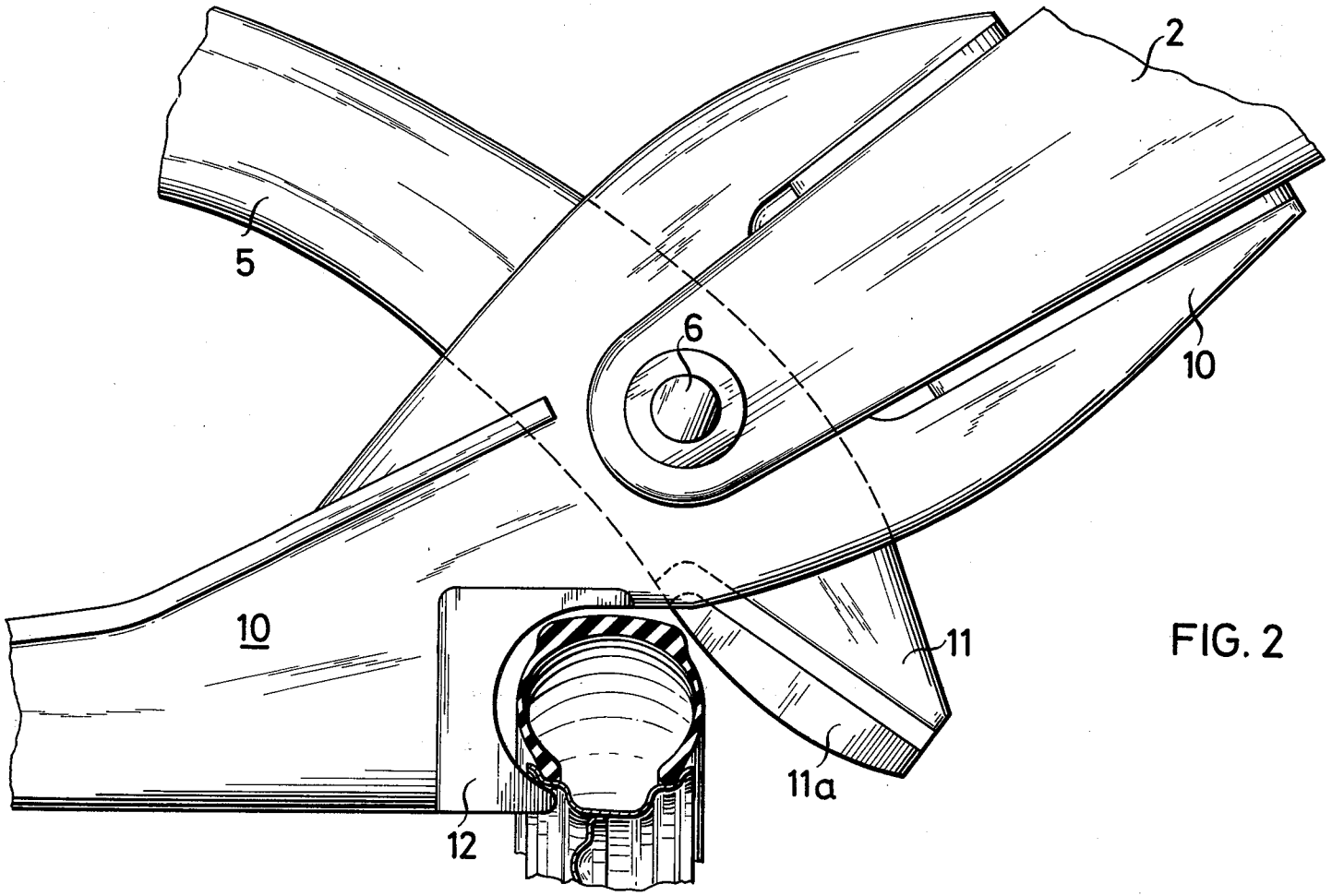

This object and other objects and advantages of the invention will appear more clearly from the following specification in connection with the accompanying drawings, in which:

FIG. 1 shows the side view of a grab with dipper arm. FIG. 2 is a side view of the cutting device for tires and forms a cut-out of FIG. 1 but on a larger scale than the latter.

The tool according to the present invention is characterized primarily in that an extension member is firmly connected to the dipper arm and projects beyond the free end of said dipper arm, said extension member cooperating in the manner of a shear or grab with a ripping tooth which is rotatably linked to the free end of the dipper arm.

According to a further development of the invention, the ripping tooth cooperates with the extension member firmly connected to the dipper arm. At that end thereof adjacent its pivot point, the same extends beyond the pivot point by means of a wing provided with a cutting edge. The wing in turn cooperates in a shear-like manner with that side of the extension member which faces away from the ripping tooth.

Referring now to the drawings in detail, the arrangement shown therein comprises a boom 1 on a non-illustrated hydraulic excavator. The arrangement shown in the drawing furthermore comprises a dipper arm 2 which in the pivot point 3 is pivotable by means of the hydraulic cylinder 4 a vertical plane. At the free end of the dipper arm 2 there is provided a ripping tooth 5 which is pivotally mounted in the pivot 6 and by means of the hydraulic cylinder 7 journaled in the dipper arm and more specifically in the fixed point 7*a* thereof, is actuated by means of the levers 8 and 9. On that side of the dipper arm 2 which faces away from the hydraulic cylinder 7, the extension member 10 is connected to the free end of the dipper arm.

The ripping tooth 5 at that end thereof which is adjacent to the pivot point is extended by a wing 11 which forms one piece with the ripping tooth 5. The wing 11 at that end thereof which faces the extension member 10 is provided with a cutting edge 11*a*. The extension member 10 at that side which faces the wing 11 is provided with a semicircular counter edge 12 which forms the counter cutting edge to the cutting edge 11*a* of the wing 11.

When actuating the ripping tooth 5 by means of the hydraulic cylinder 7, the ripping tooth 5 will be able when occupying the dash-line position in which the extension member 10 forms the counter-bearing to the ripping tooth 5, to grasp articles in a plier-like manner and tear the same out, for instance upholstered parts from scrap automobiles. The rubber tires of scrap automobiles, by means of the scissor-like arrangement 11, 11*a*, 12 can be cut as shown in FIG. 2 so that the rubber tires drop off from the rims.

It is, of course, to be understood, that the present invention is, by no means, limited to the specific showing in the drawings but also comprises any modifications within the scope of the appended claims.

What I claim is:

1. In combination with a dipper arm having a free end portion and forming part of an excavator, a tool including an extension member fixedly connected to said dipper arm and projecting beyond said free end portion of said dipper arm and having an outer free end, ripping tooth means rotatably supported by said free end portion of said dipper arm, and together with said extension member forming a gripping and shearing structure simultaneously, power operable means supported by said dipper arm and operatively connected to said ripping tooth means for selectively pivoting said ripping tooth means toward and away from said extension member, said ripping tooth means forming a two-arm lever having a longer arm for cooperation with the outer free end of said extension member and also having a shorter arm, first shear means supported by said extension member and in operative position facing said shorter arm, and second shear means supported by said shorter arm for cooperation with said first shear means in response to the pivoting of said shorter arm toward said first shear means.

* * * * *